US010035362B2

(12) United States Patent
Jimbo

(10) Patent No.: US 10,035,362 B2
(45) Date of Patent: Jul. 31, 2018

(54) THERMAL PRINTER WITH LIQUID DRAIN STRUCTURE

(71) Applicant: Seiko Instruments Inc., Chiba-shi, Chiba (JP)

(72) Inventor: Takashi Jimbo, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/346,215

(22) Filed: Nov. 8, 2016

(65) Prior Publication Data

US 2017/0129261 A1 May 11, 2017

(30) Foreign Application Priority Data

Nov. 9, 2015 (JP) ..... 2015-219613

(51) Int. Cl.
*B41J 11/04* (2006.01)
*B41J 2/32* (2006.01)
*B41J 29/02* (2006.01)

(52) U.S. Cl.
CPC ..... *B41J 11/04* (2013.01); *B41J 2/32* (2013.01); *B41J 29/02* (2013.01)

(58) Field of Classification Search
CPC ..... B41J 11/04; B41J 2/32; B41J 29/02
See application file for complete search history.

(56) References Cited

U.S. PATENT DOCUMENTS

2009/0032637 A1 2/2009 Yoshioka
2015/0002605 A1* 1/2015 Aizawa ..... B41J 15/042 347/222
2015/0139686 A1 5/2015 Takenoshita et al.

FOREIGN PATENT DOCUMENTS

JP H03-217861 A 9/1991
JP 2002-137493 A 5/2002
JP 2015-30097 A 2/2015
JP 2015-030097 A 2/2015

OTHER PUBLICATIONS

Extended Search Report in corresponding European Application No. 16197812.7, dated Mar. 31, 2017, 8 pages.

* cited by examiner

*Primary Examiner* — Bradley Thies
(74) *Attorney, Agent, or Firm* — Brinks Gilson & Lione

(57) ABSTRACT

A thermal printer includes: a housing having a roll sheet receiving portion; a thermal head printing on a recording paper drawn out from the roll sheet; a platen roller feeding the recording paper and held in abutment against the thermal head; a delivery slot through which the recording paper having been subjected to printing by the thermal head is delivered to an outside of the housing, the delivery slot being formed in the housing; a retaining portion for retaining liquid having entered the housing in an assumed carriage posture assumed as a posture during carriage, the retaining portion being formed below the delivery slot in a gravitational direction; and a flow path for guiding the liquid having entered the housing to the retaining portion.

8 Claims, 9 Drawing Sheets

THERMAL PRINTER WITH LIQUID DRAIN STRUCTURE

RELATED APPLICATIONS

This application claims priority under 35 U.S.C. § 119 to Japanese Patent Application No. 2015-219613 filed on Nov. 9, 2015, the entire content of which is hereby incorporated by reference.

BACKGROUND OF THE INVENTION

1. Field of the Invention

The present invention relates to a thermal printer.

2. Description of the Related Art

Hitherto, as a printer configured to perform printing on a recording paper (heat-sensitive paper), there has been known a thermal printer. As the thermal printer, there have been known various printers in which a paper cover is coupled to a casing for receiving a roll sheet in an openable and closable manner so that the roll sheet can easily be set.

The thermal printer is sometimes used in an environment where drip-proof performance is required, such as outdoors and a kitchen of a restaurant. In such an environment where the drip-proof performance is required, there is a risk in that liquids, such as rainwater during outdoor work, moisture adhesion on a user's hand, water splashed in the kitchen, and the like may enter the printer through a boundary portion between the casing and the paper cover to adhere to the roll sheet, a circuit board, and the like. When the liquid adheres to the roll sheet or the circuit board, a printing failure or a malfunction of electric components may be caused. Therefore, the printer needs to have a feature to protect the printer against the liquid, such as the structure which prevents entry of water thereinto, and the structure which can cause water having entered the printer to be discharged without adhesion of the water to the roll sheet or the circuit board.

SUMMARY OF THE INVENTION

According to one embodiment of the present invention, there is provided a thermal printer, including: a housing having a roll sheet receiving portion; a thermal head printing on a recording paper drawn out from the roll sheet; a platen roller feeding the recording paper and held in abutment against the thermal head; a delivery slot through which the recording paper having been subjected to printing by the thermal head is delivered to an outside of the housing, the delivery slot being formed in the housing; a retaining portion for retaining liquid having entered the housing in an assumed carriage posture assumed as a posture during carriage, the retaining portion being formed below the delivery slot in a gravitational direction; and a flow path for guiding the liquid having entered the housing to the retaining portion.

In the above-mentioned thermal printer according to the one embodiment of the present invention, the flow path is formed immediately below a platen shaft of the platen roller, and has an inclination that a center portion in a horizontal direction thereof is positioned higher, and that portions on the retaining portion sides located at both sides in the horizontal direction are positioned lower.

In the above-mentioned thermal printer according to the one embodiment of the present invention, the housing includes: an opening and closing cover configured to open and close the roll sheet receiving portion; and a hinge portion pivotally supporting the opening and closing cover, and the hinge portion has a liquid discharge port for discharging liquid retained in the retaining portion to an outside.

In the above-mentioned thermal printer according to the one embodiment of the present invention, the thermal printer further includes a flow unit for guiding the liquid retained in the retaining portion to the liquid discharge port.

DETAILED DESCRIPTION OF THE PREFERRED EMBODIMENTS

Next, an embodiment of the present invention is described with reference to the drawings.

Figure 1:
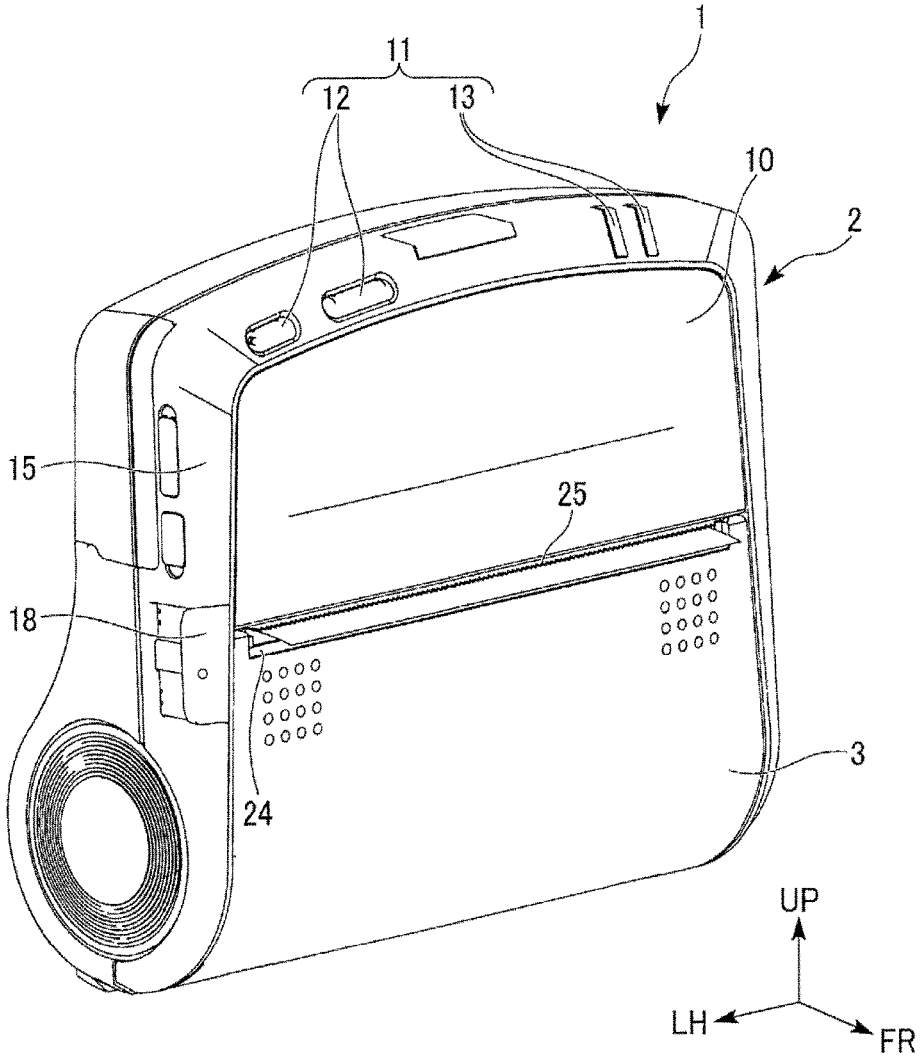
FIG. 1 is a perspective view of a thermal printer, for illustrating a state in which a paper cover takes a closed position.
Figure 2:
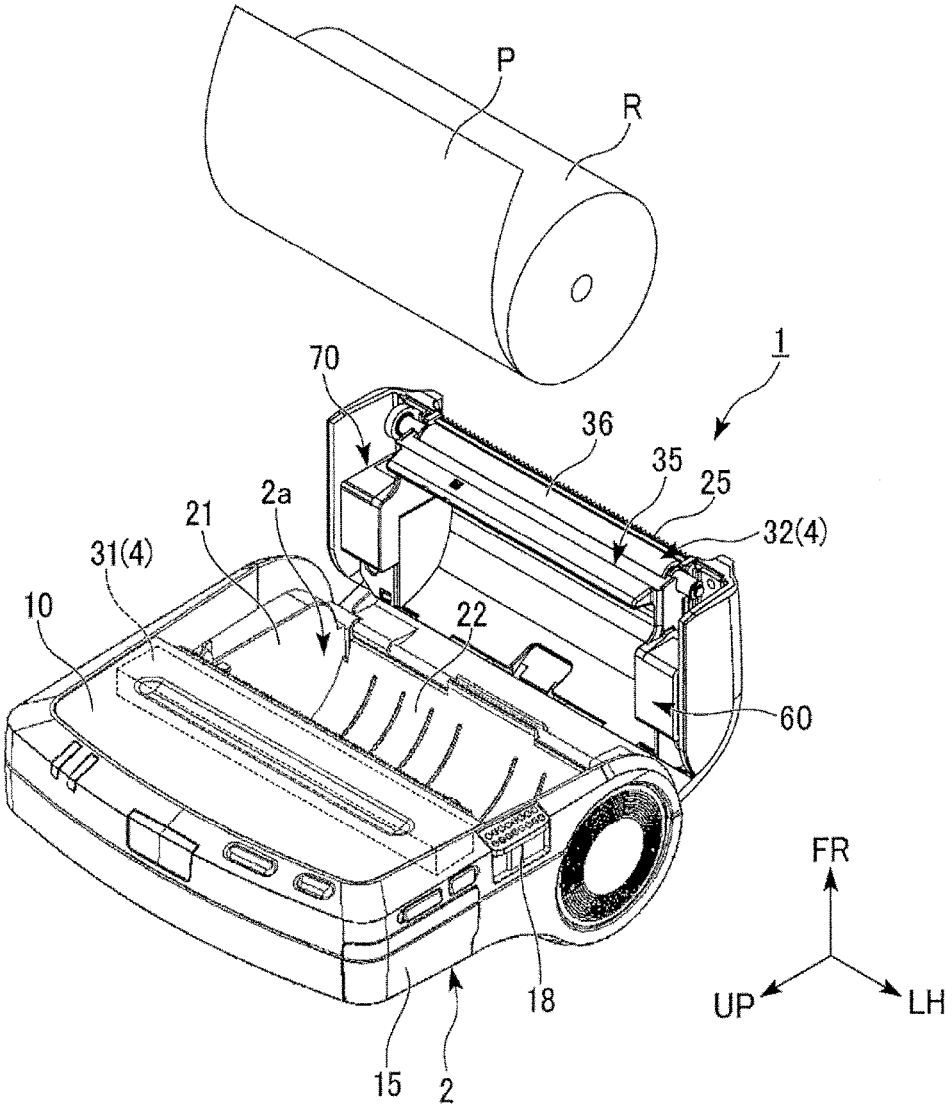
FIG. 2 is a perspective view of the thermal printer, for illustrating a state in which the paper cover takes a closed position.

FIG. 1 is a perspective view of a thermal printer 1, for illustrating a state in which a paper cover 3 takes a closed position. FIG. 2 is a perspective view of the thermal printer 1, for illustrating a state in which the paper cover 3 takes an opened position. In the following description, for easy understanding of the invention, the illustrations are simplified, for example, by omitting a part of structural components, simplifying shapes of the structural components, and modifying scales of the structural components, as appropriate. Further, in the drawings, FR represents a forward direction. LH represents a leftward direction. UP represents an upward direction. Further, in FIG. 3 to FIG. 9, for the description of the structure of each structural component, each structural component is illustrated with an orientation under a state in which the paper cover 3 of the thermal printer 1 is closed. Further, the thermal printer 1 is sometimes used while being carried by a user, and hence a vertical direction of the thermal printer 1 may not be determined in such a case. In this embodiment, a state in which the thermal printer 1 is oriented with the forward and backward directions, rightward and leftward directions, and the upward and downward directions that are illustrated in FIG. 1 represents an assumed carriage posture that is assumed as a posture during carriage, and the thermal printer 1 in this assumed carriage posture is described.

As illustrated in FIG. 1 and FIG. 2, the thermal printer 1 includes a casing 2 being a housing. The casing 2 has an opening portion 2*a* formed therein. The thermal printer 1 further includes a paper cover 3 serving as an opening and closing cover configured to open and close the opening portion 2*a*. The paper cover 3 is rotatably supported by the casing 2. The thermal printer 1 further includes a printing unit 4 received in the casing 2.

The casing 2 is made of a resin material, e.g., polycarbonate, or a metal material. An upper portion of the casing 2 is formed into a rectangular parallelepiped shape having a front wall 10, whereas a lower portion of the casing 2 is formed into a box shape having the opening portion 2*a* being opened forward. An operation unit 11 configured to perform various operations of the thermal printer 1 is arranged on an upper portion of the front wall 10 of the casing 2. As the operation unit 11, various function switches 12 and various lamps 13 are arranged. The various function switches 12 include a power switch, a FEED switch, or other switches. The various lamps 13 are arranged adjacent to the function switches 12 and include a POWER lamp for notifying information on an ON/OFF state of the power switch, an ERROR lamp for notifying the error or the like of the thermal printer 1, or other lamps. Further, an open button 18 for opening the paper cover 3 is arranged between the front wall 10 and a side wall 15 of the casing 2.

In the lower portion of the casing 2, there is defined a roll sheet receiving portion 21 for receiving a roll sheet R through the opening portion 2*a*. The roll sheet receiving portion 21 includes a guide plate 22 for holding the roll sheet R, and holds the roll sheet R between the guide plate 22 and an inner surface of the paper cover 3 so as to cover the roll sheet R. The guide plate 22 has an arc-shaped cross section when viewed in the rightward and leftward directions. The guide plate 22 holds the roll sheet R in a state in which an outer peripheral surface of the roll sheet R is held in contact with an inner peripheral surface of the guide plate 22, and guides a recording paper P drawn out from the roll sheet R to the printing unit 4. The recording paper P employed in this embodiment is a heat sensitive paper and suitably used for printing of various types of labels, receipts, and tickets and the like. This recording paper P forms the roll sheet R having a hollow hole by being wound into a roll. Then, the printing unit 4 performs printing on a region of the recording paper P, which is drawn out from the roll sheet R.

The paper cover 3 is made of a resin material, e.g., polycarbonate. A hinge structure (not shown) configured to pivotally support the paper cover 3 is formed in the lower portion of the paper cover 3. The paper cover 3 is rotatable with respect to the casing 2 by virtue of the hinge structure. The hinge structure is formed such that a hinge shaft arranged in the casing 2 and a hinge plate arranged in the paper cover 3 are rotatably supported. Further, the paper cover 3 is formed such that an upper end thereof is lockable with the casing 2 through intermediation of a platen unit 32 described later. Through push of the open button 18, the casing 2 and the paper cover 3 are unlocked, and the paper cover 3 rotates from the closed position illustrated in FIG. 1 to the opened position illustrated in FIG. 2. Further, in the state in which the paper cover 3 takes the closed position, a clearance formed between an upper end edge of the paper cover 3 and a lower end edge of the front wall 10 of the casing 2 serves as a delivery slot 24 through which the recording paper P to be printed by the printing unit 4 is delivered.

Cutting blades 25, which are configured to cut the recording paper P delivered through the delivery slot 24, are arranged at an opening edge of the delivery slot 24. The cutting blades 25 are integrally arranged at the lower end edge of the front wall 10 of the casing 2 (portion located on an upper side of the opening edge), and at an upper end edge of the paper cover 3, respectively. The recording paper P is pulled and moved toward the cutting blades 25 so that the recording paper P is cut.

Further, a strap or a hook is mountable to an upper portion on a back surface of the casing 2. When a user or the like carries the thermal printer 1, it is assumed that the user may often carry the thermal printer 1 while putting a strap around the user's neck or shoulder, or mounting a hook to a waist belt. Therefore, the state in which the thermal printer 1 is oriented with the forward and backward directions, the rightward and leftward directions, and the upward and downward directions that are illustrated in FIG. 1 represents the assumed carriage state.

The printing unit 4 includes a head unit 31 and the platen unit 32. The head unit 31 is arranged in a lower end portion of the front wall 10 of the casing 2. The platen unit 32 is arranged in an upper end portion of the paper cover 3 and is removably coupled to the head unit 31 in accordance with an opening and closing operation of the paper cover 3. As illustrated in FIG. 2, the platen unit 32 includes a platen frame 35 mounted to the paper cover 3 and a platen roller 36 rotatably supported by the platen frame 35.

Figure 3:
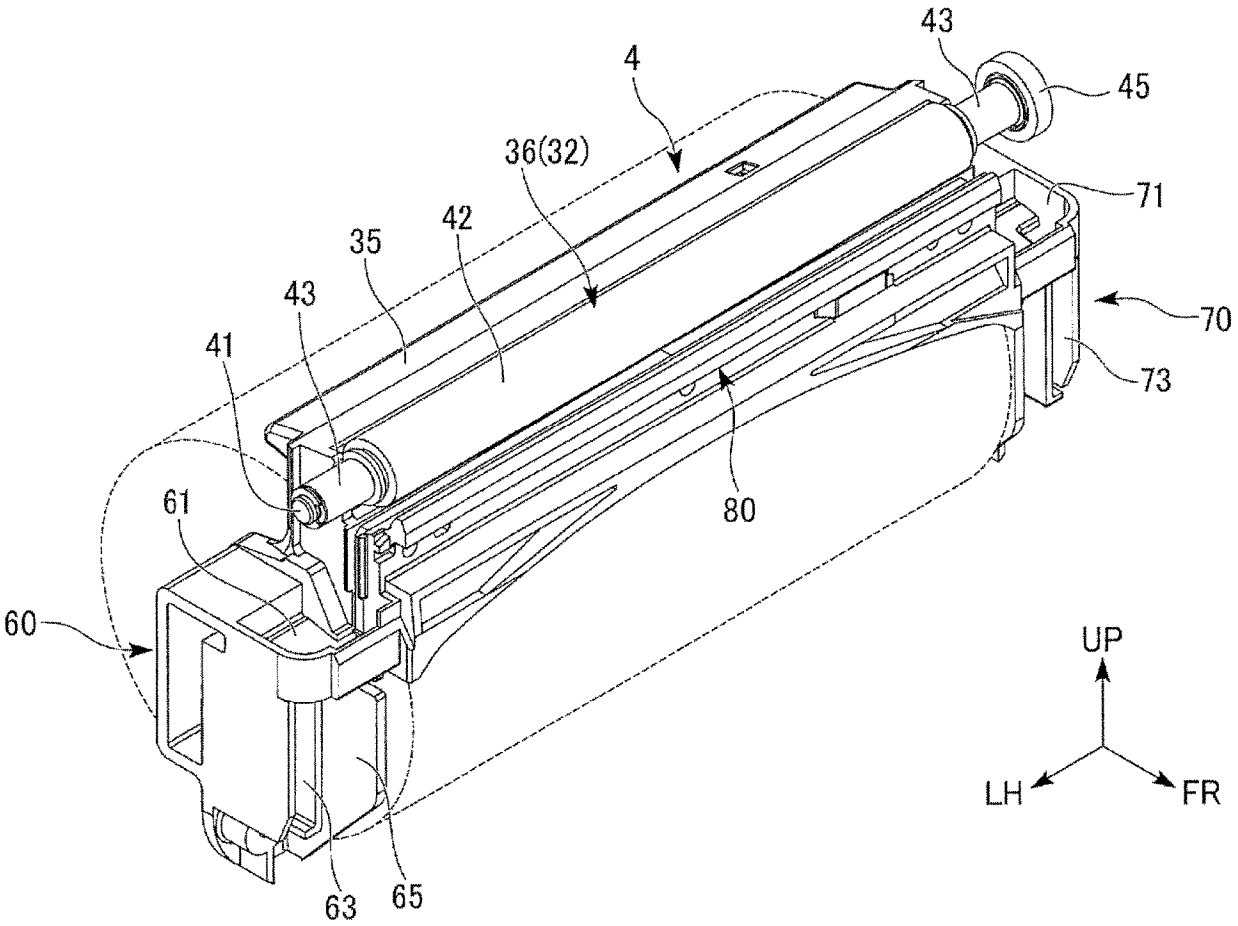
FIG. 3 is a perspective view for illustrating a platen unit of a printing unit when viewed from above.
Figure 4:
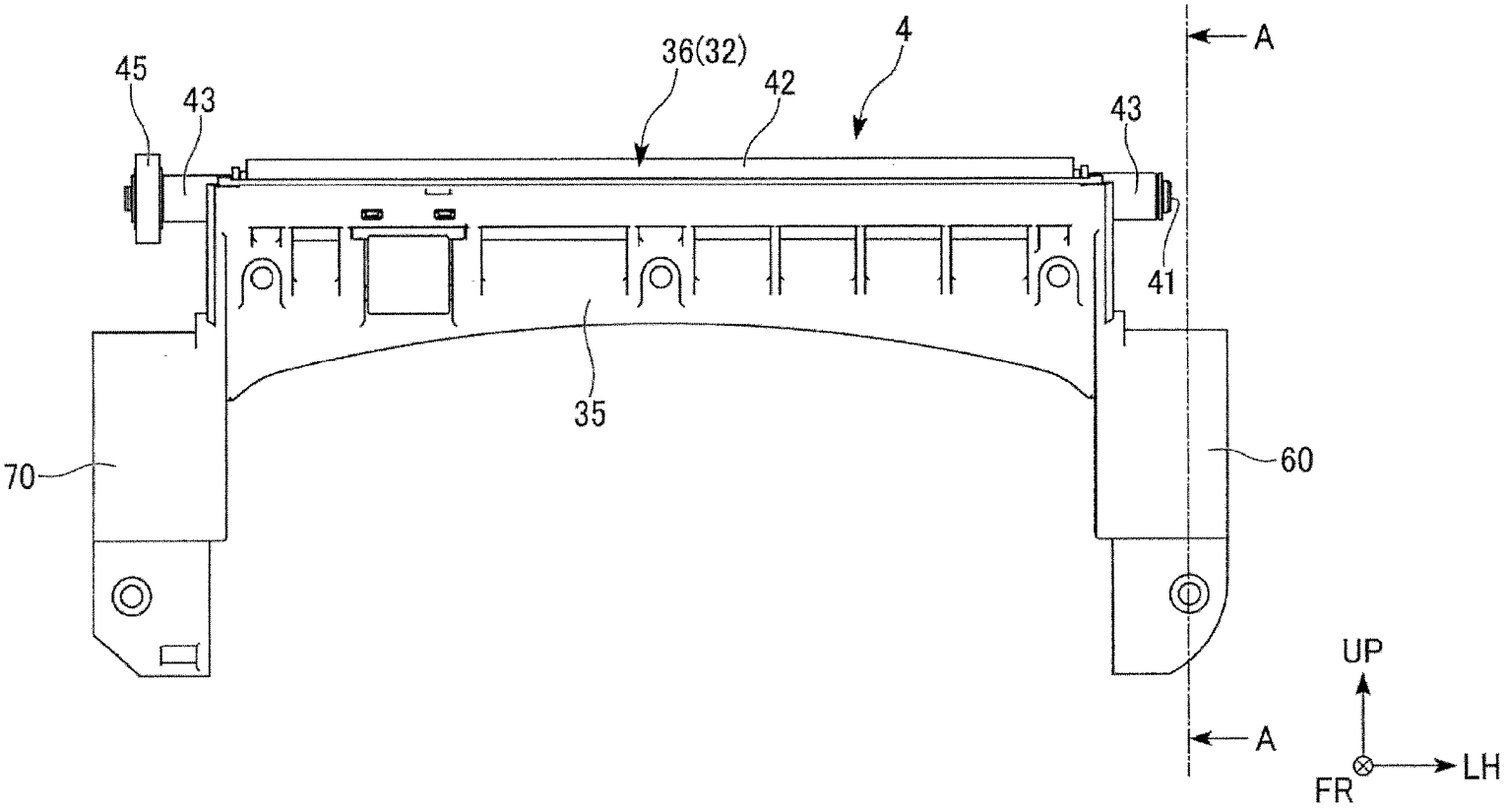
FIG. 4 is a rear view for illustrating the platen unit of the printing unit when viewed from the rear.

FIG. 3 is a perspective view for illustrating the platen unit 32 of the printing unit 4 when viewed from above. FIG. 4 is a rear view for illustrating the platen unit 32 when viewed from the rear. As illustrated in FIG. 3, the platen roller 36 includes a platen shaft 41 extending along the rightward and leftward directions and a roller main body 42 made of a rubber or the like, which is externally mounted to the platen shaft 41. Bearings 43 configured to rotatably support the platen shaft 41 are externally mounted at both end portions of the platen shaft 41. Each bearing 43 is held by the platen frame 35 (see FIG. 2), and the platen roller 36 is rotatably supported by the platen frame 35 through intermediation of the bearings 43.

A platen gear 45 is mounted to a right end portion of the platen shaft 41. Further, the head unit 31 includes a gear train mechanism (not shown) brought in mesh with the platen gear 45 and a motor (not shown) connected to the gear train mechanism. When the platen unit 32 and the head unit 31 are coupled to each other, the platen gear 45 is brought in mesh with the gear train mechanism arranged on the head unit 31 side, to thereby transmit a rotational driving force of the motor to the platen roller 36. In addition, when the platen unit 32 and the head unit 31 are coupled to each other, a thermal head of the head unit 31 is brought into press contact with an outer peripheral surface of the platen roller 36.

Figure 5:
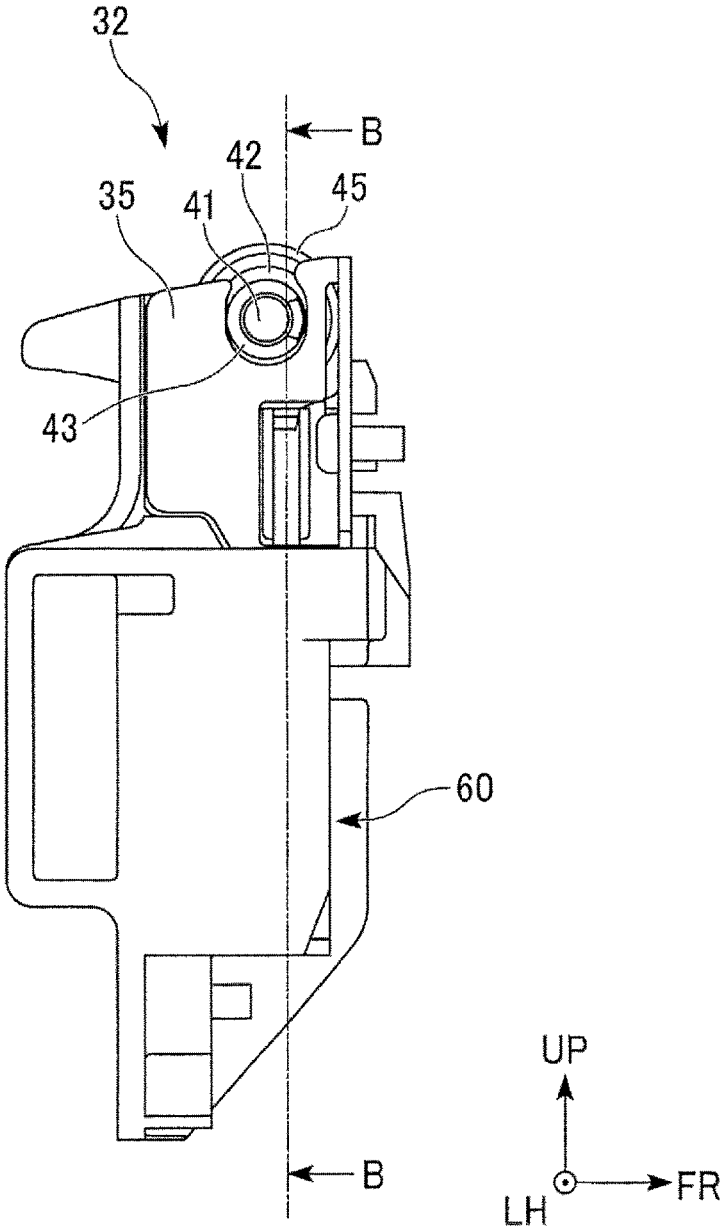
FIG. 5 is a side view for illustrating the platen unit when viewed from the left.
Figure 6:
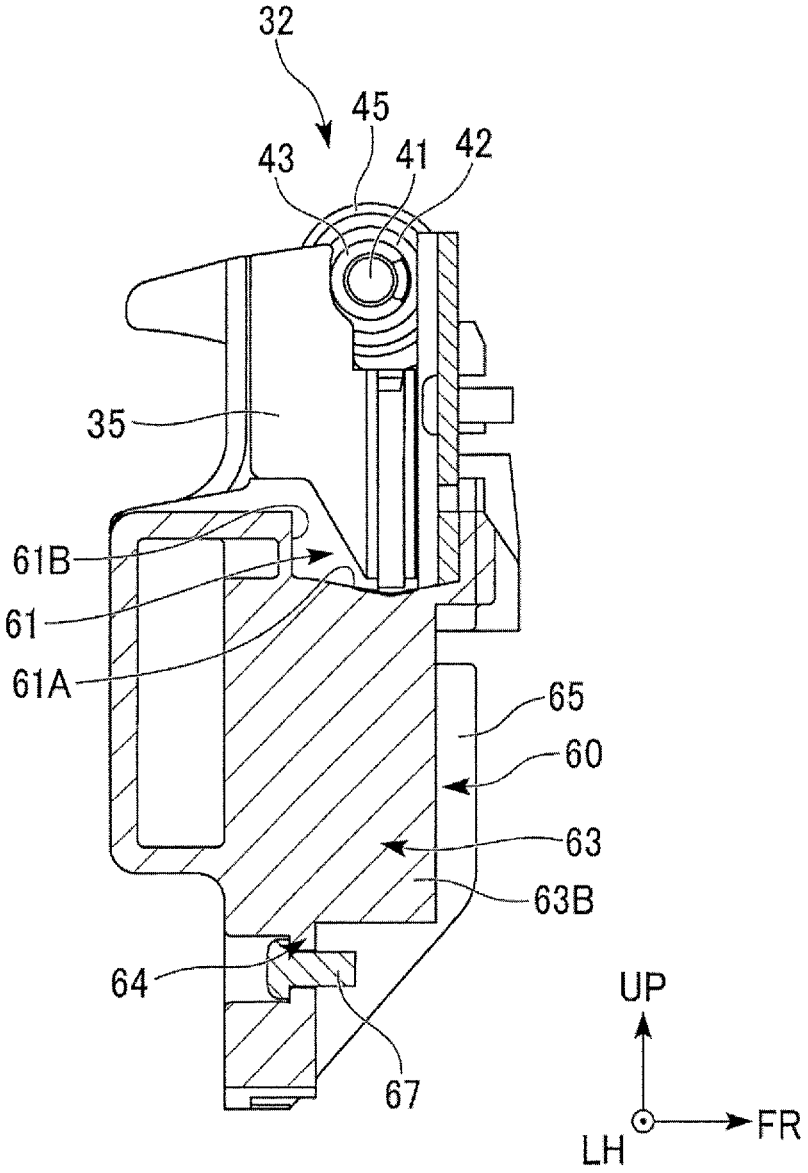
FIG. 6 is a sectional view taking along the line A-A of FIG. 4.
Figure 7:
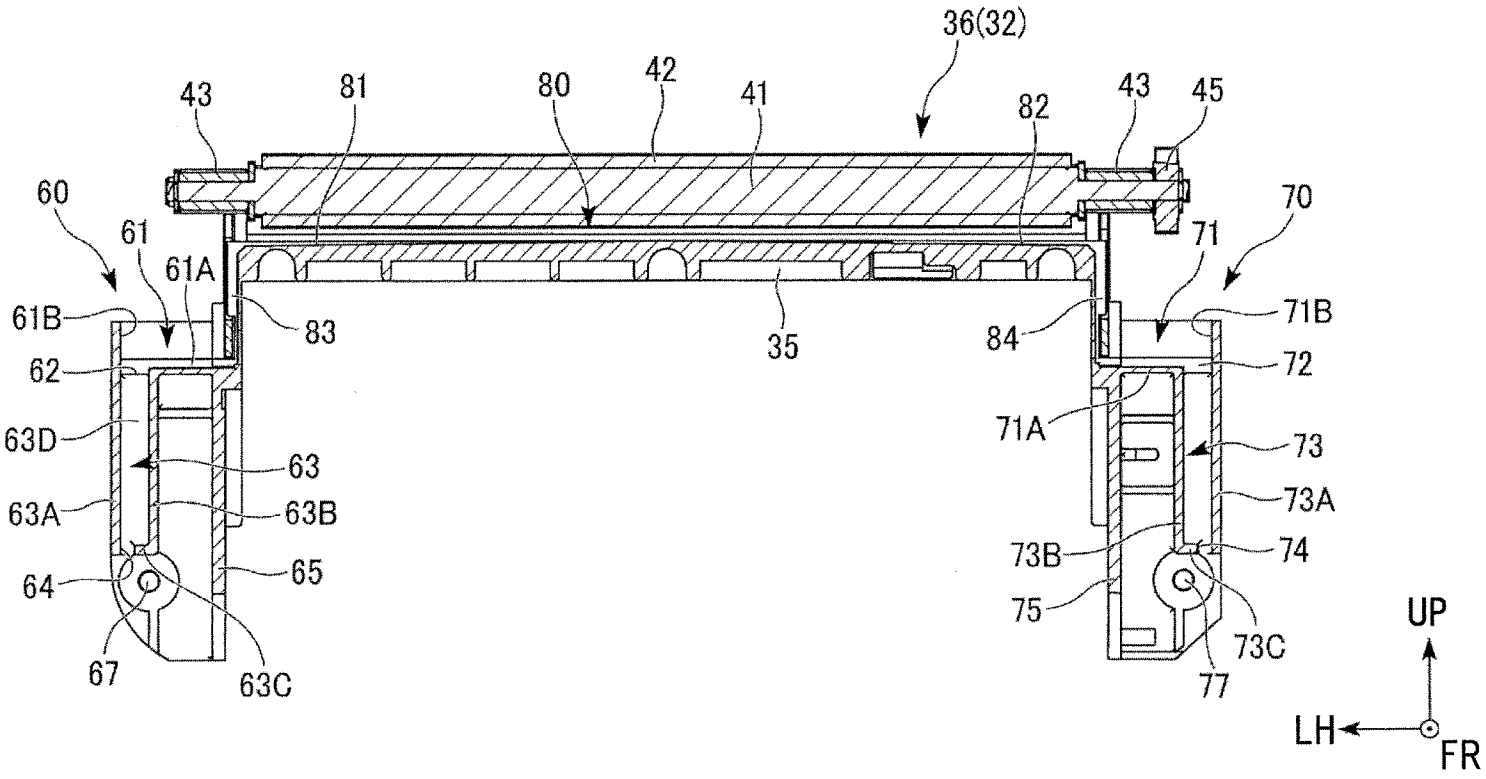
FIG. 7 is a sectional view taking along the line B-B of FIG. 5.
Figure 8:
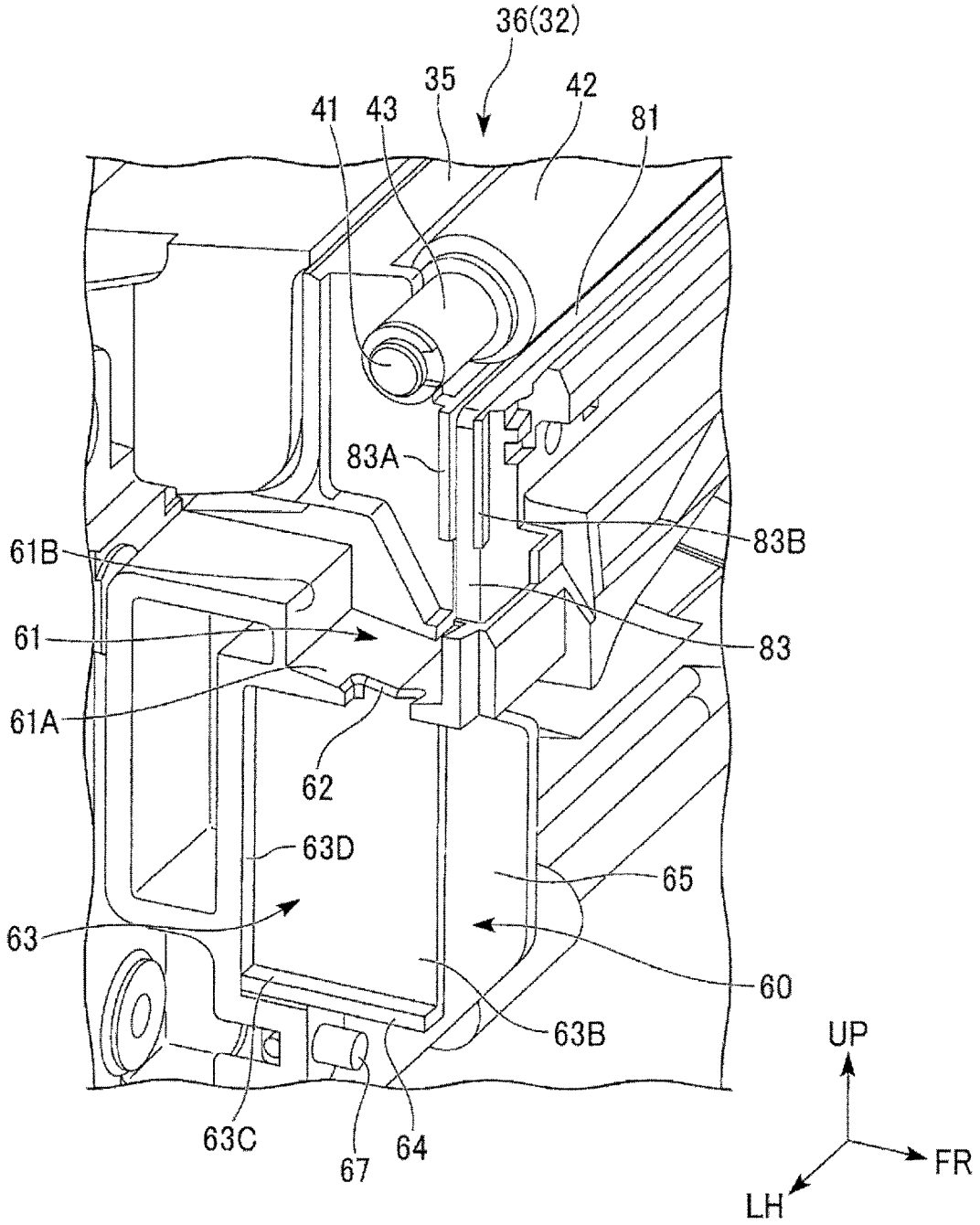
FIG. 8 is a perspective view of a left liquid discharge structure.
Figure 9:
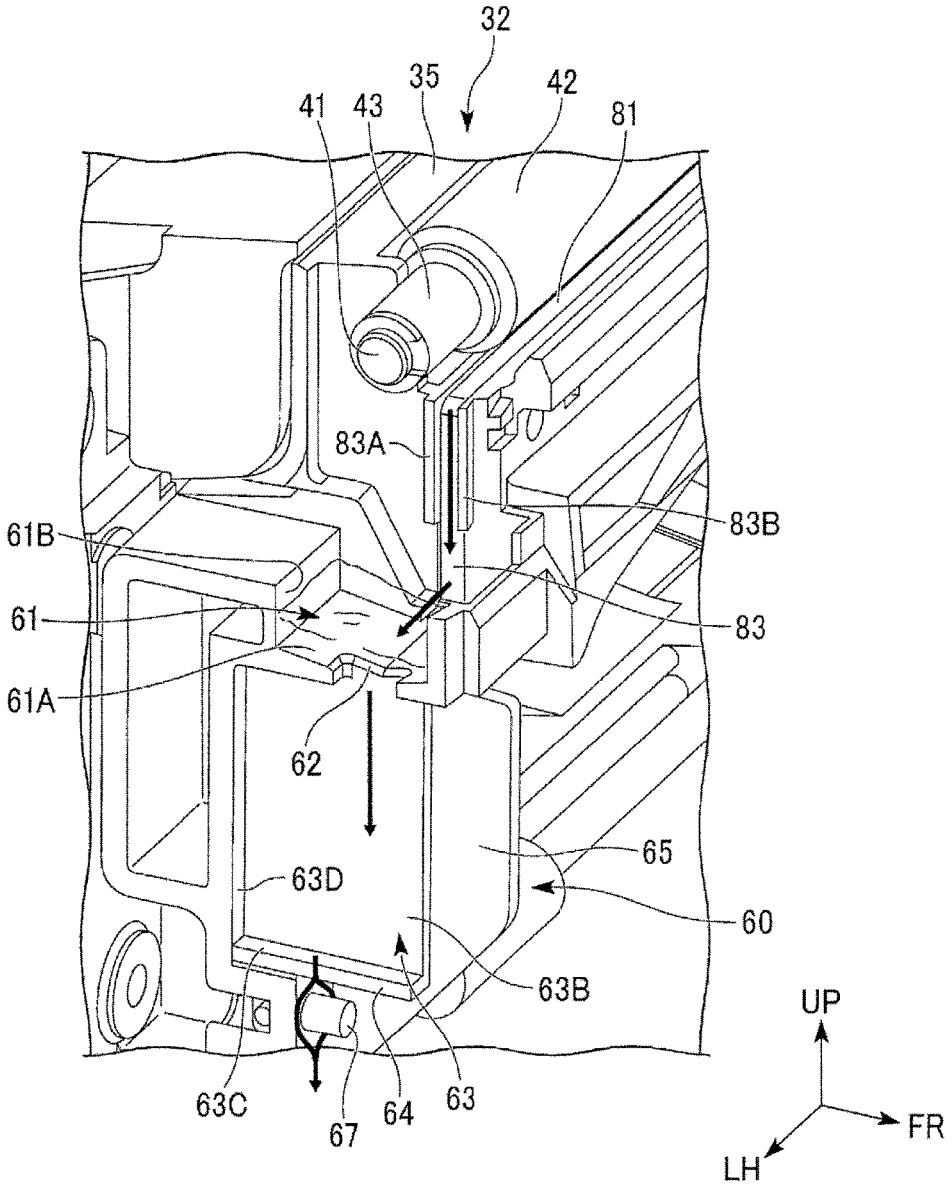
FIG. 9 is an explanatory view for illustrating a flow of liquid in a casing, which corresponds to a perspective view of the left liquid discharge structure.

FIG. 5 is a side view for illustrating the platen unit 32 when viewed from the left. FIG. 6 is a sectional view taking along the line A-A of FIG. 4. FIG. 7 is a sectional view taking along the line B-B of FIG. 5. FIG. 8 is a perspective view of a left liquid discharge structure. As illustrated in FIG. 3 to FIG. 7, a left liquid discharge structure 60 is formed integrally with the platen frame 35 on a left side of the platen frame 35 of the platen unit 32. Further, as illustrated in FIG. 4 and FIG. 7, a right liquid discharge structure 70 is formed integrally with the platen frame 35 on a right side of the platen frame 35.

Further, as illustrated in FIG. 7, a flow path 80 for guiding liquid having entered the casing 2 into a retaining portion is formed in front of the platen frame 35. The liquid discharge structures 60 and 70 are formed below the flow path 80 in a gravitational direction. Moreover, the liquid discharge structures 60 and 70 are formed below the delivery slot 24, which may be the liquid entry path, in the gravitational direction.

Further, the flow path 80 is formed above the roll sheet receiving portion 21 for receiving the roll sheet R in the gravitational direction. The delivery slot 24 is formed above the roll sheet receiving portion 21 in the gravitational direction, and the liquid having entered through the delivery slot 24 drops downward. At this time, the flow path 80 is formed above the roll sheet receiving portion 21 in the gravitational direction, and thus, the drop of the liquid is prevented by the flow path 80. With this, the entry of the liquid into the roll sheet receiving portion 21 is suppressed.

The liquid discharge structures 60 and 70 are formed below the flow path 80 in the gravitational direction. Moreover, the liquid discharge structures 60 and 70 are formed below the delivery slot 24, which may be a liquid entry path, in the gravitational direction. As illustrated in FIG. 3 and FIG. 6 to FIG. 8, the left liquid discharge structure 60 has formed a retaining bath 61 serving as a retaining portion for retaining the liquid having entered the casing 2. The retaining bath 61 is formed to be surrounded by a retaining bath bottom portion 61A having an approximately rectangular shape in plan view and four retaining bath side wall portions 61B extending upright from sides of the retaining bath bottom portion 61A. Further, a retaining bath opening portion is formed at an upper surface of the retaining bath 61, and thus the liquid, for example, water guided from the flow path 80, flows through the retaining bath opening portion into the retaining bath 61. Thus, the liquid can temporarily be retained in the retaining bath 61. The retaining bath bottom portion 61A has an inclined surface, and a small diameter port 62 is formed at a lowermost end position of the inclined surface.

The small diameter port 62 is formed below the retaining bath 61 in the gravitational direction to cause the liquid retained in the retaining bath 61 to flow therethrough. The small diameter port 62 has a small diameter and a small opening area. Thus, a flow rate of the liquid through the small diameter port 62 per unit time is limited. Therefore, the liquid introduced from the flow path 80 is liable to be retained in the retaining bath 61.

A liquid guide region 63 is formed below the small diameter port 62 in the gravitational direction. The liquid guide region 63 is surrounded by an outer wall 63A, an inner wall 63B, a bottom portion 63C, and a rear surface portion 63D. Further, the paper cover 3 is held in abutment against front surfaces of the outer wall 63A, the inner wall 63B, and the bottom portion 63C. In this manner, the liquid guide region 63 is formed to be surrounded by the outer wall 63A, the inner wall 63B, the bottom portion 63C, the rear surface portion 63D, and the paper cover 3.

In addition, a discharge port 64 is formed in the bottom portion 63C of the liquid guide region 63. An opening area of the discharge port 64 is set to be larger than that of the small diameter port 62 formed in the retaining bath bottom portion 61A of the retaining bath 61. Further, a length of the liquid guide region 63 in a height direction is set to be larger than that of the retaining bath 61, but a bottom area of the liquid guide region 63 is set to be smaller than that of the retaining bath 61. Therefore, when volumes of the retaining bath 61 and the liquid guide region 63 are compared, the volume of the retaining bath 61 is set to be larger than that of the liquid guide region 63.

Further, a partition wall 65 is arranged further inward of the inner wall 63B of the liquid guide region 63. The roll sheet R is arranged further inward of the partition wall 65. The partition wall 65 prevents the entry of the liquid from an outer side of the partition wall 65. In this manner, an edge portion of the roll sheet R is prevented from being wet. Further, a boss 67 is arranged below the bottom portion 63C forming the liquid guide region 63. The left liquid discharge structure 60 is made of a resin material in common with the platen frame 35, and the platen frame 35 and the left liquid discharge structure 60 are integrally molded with a common mold. Therefore, the platen frame 35 and the retaining bath 61, and the platen frame 35 and the liquid guide region 63 are integrally formed.

As illustrated in FIG. 7, a structure and a shape of the right liquid discharge structure 70 are slightly different from those of the left liquid discharge structure 60, but the right liquid discharge structure 70 has a substantially common structure with the left liquid discharge structure 60. The right liquid discharge structure 70 has a retaining bath 71 surrounded by a retaining bath bottom portion 71A and retaining bath side wall portions 71B. A small diameter port 72 is formed in the retaining bath bottom portion 71A.

Further, a liquid guide region 73 is formed below the retaining bath 71 in the gravitational direction by being surrounded by an outer wall 73A, an inner wall 73B, a bottom portion 73C, and a rear surface portion 73D. A discharge port 74 is formed in the bottom portion 73C. Further, a partition wall 75 is arranged further inward of the inner wall 73B and a boss 77 is arranged below the bottom portion 73C. Similarly to the left liquid discharge structure 60, the right liquid discharge structure 70 is also made of a resin material in common with the platen frame 35, and the platen frame 35 and the right liquid discharge structure 70 are integrally molded with a common mold. Therefore, the platen frame 35 and the retaining bath 71, and the platen frame 35 and the liquid guide region 73 are integrally formed.

Further, the flow path 80 includes a left flow path 81 and a right flow path 82. The right and left flow paths 81 and 82 are formed immediately below the platen shaft 41 of the platen roller 36. The left flow path 81 is formed on a left side with respect to a center of the thermal printer 1 in the rightward and leftward directions, and the right flow path 82 is formed on a right side with respect to the center of the thermal printer 1 in the horizontal direction. The paper cover 3 is arranged in front of the flow path 80 and serves as a wall surface on one side of the right and left flow paths 81 and 82.

The flow path 80 has a center portion in a longitudinal direction positioned at an uppermost position in the gravitational direction. The left flow path 81 has a right end portion positioned at the uppermost position in the gravitational direction, and a left end portion positioned at a lowermost position in the gravitational direction. Further, the right flow path 82 has a left end portion positioned at the uppermost position in the gravitational direction, and a right end portion positioned at the lowermost position in the gravitational direction. In this manner, the right and left flow paths 81 and 82 are inclined so as to be lower on a retaining bath side than on a non-retaining bath side.

Further, a left guide path 83 is formed at the left end portion (outer end portion) of the left flow path 81. The left guide path 83 is formed along the gravitational direction, and has an upper end portion connected to the left flow path 81 and a lower end portion connected to the retaining bath 61. With this structure, the liquid having flowed through the left flow path 81 is guided into the retaining bath 61 through the left guide path 83. Guide walls 83A and 83B extending along the gravitational direction are formed at front and back positions of the left guide path 83 (right and left positions of the left guide path 83 when viewed from a front side).

Further, a right guide path similar to the left guide path 83 is formed at the right end portion (outer end portion) of the right flow path 82. The right guide path 83 is formed along the gravitational direction, and has an upper end portion connected to the right flow path 82 and a lower end portion connected to the retaining bath 71. With this structure, the liquid having flowed through the left flow path 81 is guided into the retaining bath 71 through the right guide path. Similarly to the left guide path 83, guide walls extending along the gravitational direction are formed at front and back positions of the right guide path (right and left positions of the right guide path when viewed from a front side).

Next, description is made of a process of discharging the liquid having entered the casing 2 of the thermal printer 1, and the action and effect of the thermal printer 1 according to this embodiment. In the thermal printer 1 according to this embodiment, when the liquid enters the casing 2 to wet the roll sheet R, for example, there arises an adverse effect on the recording paper P. In order to avoid such a situation, it is preferred to keep the liquid having entered the casing 2 away from the roll sheet R.

Most of the liquid having entered through the delivery slot 24 illustrated in FIG. 1 flows through the left flow path 81 of the flow path 80 to be guided into the left liquid discharge structure 60, or flows through the right flow path 82 to be guided into the right liquid discharge structure 70. Here, with reference to FIG. 9, description is made of a typical flow process of the liquid flowing through the left flow path 81 to be guided into the left liquid discharge structure 60.

The liquid having flowed through the left flow path 81 to be guided into the left liquid discharge structure 60 flows through the left guide path 83 into the retaining bath 61 of the left liquid discharge structure 60. In the retaining bath 61, the liquid having flowed through the left flow path 81 is retained. However, the liquid gradually flows through the small diameter port 62, which is formed in the retaining bath bottom portion 61A, into the liquid guide region 63.

The liquid having flowed into the liquid guide region 63 flows downward therein in the gravitational direction, and is discharged through the discharge port 64 formed in the bottom portion 63C. The liquid having been discharged through the discharge port 64 flows downward in the gravitational direction along the boss 67, and is discharged to an outside of the casing 2 through a clearance (liquid discharge port) in the hinge structure formed at a lowermost end of the casing 2.

When a liquid entry path of the casing 2 is assumed, the opening portion formed in the casing 2 is conceivable. Specifically, the delivery slot 24 for delivering the recording paper P and the clearance in the hinge structure formed at the lower portion of the casing 2 are conceivable. Of those, when the assumed carriage posture of the thermal printer 1 is taken into account, the hinge structure is less liable to be an opening that allows entry of the liquid because the hinge structure is located below the thermal printer 1 in the gravitational direction, and thus the delivery slot 24 for delivering the recording paper P is liable to be an entrance of the liquid. In particular, when the thermal printer 1 is carried outdoors, the thermal printer 1 is sometimes exposed to rain and wind. In such a case, it may be assumed that rainwater enters the thermal printer 1 through the delivery slot 24.

In the thermal printer 1 according to this embodiment, the flow path 80 is formed at a position below the delivery slot 24 in the gravitational direction. With this structure, the liquid having entered through the delivery slot 24 flows through the flow path 80. The flow path 80 includes the left flow path 81 and the right flow path 82. The left flow path 81 is formed on the left side with respect to the center of the thermal printer 1 in the rightward and leftward directions, and the right flow path 82 is formed on the right side with respect to the center of the thermal printer 1 in the rightward and leftward directions. With this structure, the liquid having entered through the delivery slot 24 is prevented from unevenly flowing through the left liquid discharge structure 60 and the right liquid discharge structure 70. Therefore, the amount of the liquid retained in the retaining baths 61 and 71 of the right and left liquid discharge structures 60 and 70 can effectively be utilized.

Further, each of the right and left flow paths 81 and 82 has an inclination which is lower on the retaining bath side than the non-retaining bath side in the gravitational direction. With this structure, the liquid having flowed to the flow path 80 can be guided into any one of the retaining baths 61 and 71. Further, the left guide path 83 is formed at the left end portion (outer end portion) of the left flow path 81. With this structure, the liquid having passed through the left flow path 81 can reliably be guided into the retaining bath 61 of the left liquid discharge structure 60. Similarly, a right guide path 84 is formed at a right end portion (outer end portion) of the right flow path 82. With this structure, the liquid having passed through the right flow path 82 can reliably be guided into the retaining bath 71 of the right liquid discharge structure 70.

Further, the retaining baths 61 and 71 are formed below the delivery slot 24 in the gravitational direction. With this structure, the liquid having entered through the delivery slot 24 flows downward due to gravity, and is guided into the retaining baths 61 and 71 through the flow path 80. Therefore, the liquid having entered through the delivery slot 24 can effectively be guided into the retaining baths 61 and 71.

Further, the retaining bath 61 has a predetermined volume and a structure that can retain the liquid to some extent. The volume of the retaining bath 61 is set to be larger than that of the flow path 80, and to be larger than that of the liquid guide region 63. Further, even when, for example, a height of an upper end of the liquid guide region 63 is increased to a height position of an upper end of the retaining bath 61, the volume of the retaining bath 61 is larger than that of the liquid guide region 63. In this regard, the same holds true for the relationship of the retaining bath 71 in the right liquid discharge structure with respect to the flow path 80 and the liquid guide region 73. In this manner, through formation of the retaining bath 61 having a large volume, the liquid having entered the casing 2 can be retained in the retaining bath 61 to some extent. Therefore, even when the liquid having entered the casing 2 is not discharged in a short period of time, for example, the liquid exposure to the roll sheet receiving portion 21 (see FIG. 2) in the casing 2 can be prevented. Thus, the liquid exposure in the casing 2 can be prevented with the suppression of an increase in size of a liquid discharge port. The liquid having entered the casing 2 is discharged to the outside of the casing 2 from the liquid discharge port formed in the hinge structure through the discharge path constructed of the flow path 80, the liquid discharge structure 60 (70), and the liquid guide region 63 (73). The entry of the liquid represents a situation where the liquid deviates from the discharge path to enter the casing 2.

Further, the opening area of the discharge port 64 formed in the bottom portion 63C of the liquid guide region 63 is set to be larger than that of the small diameter port 62 formed in the retaining bath bottom portion 61A of the retaining bath 61. With this structure, the liquid, which has passed through the small diameter port 62 and has entered the liquid guide region 63, can be discharged through the discharge port 64 with little chance for the liquid to be retained in the liquid guide region 63.

Further, the liquid having been retained in the retaining bath 61 is guided downward in the gravitational direction through the liquid guide region 63, and discharged through the discharge port 64 formed in the bottom portion 63C. The liquid guide region 63 is surrounded by the outer wall 63A, the inner wall 63B, the bottom portion 63C, the rear surface portion 63D, and the paper cover 3. With this structure, the entry of the liquid into the roll sheet receiving portion 21 can be suppressed, and thus a situation of wetting the roll sheet R can be prevented. Further, the partition wall 65 is arranged between the liquid guide region 63 and the roll sheet receiving portion 21. With this structure, the entry of the liquid into the roll sheet receiving portion 21 can suitably be prevented.

Further, the boss 67 is arranged below the discharge port 64 formed in the bottom portion 63C of the liquid guide region 63. With this structure, the liquid having discharged through the discharge port 64 smoothly flows downward in the gravitational direction along the boss 67. Therefore, a situation of splashing the liquid having discharged through the discharge port 64 in the casing 2 can be prevented.

Further, the liquid discharge port for discharging the liquid having entered the casing 2 to the outside of the casing 2 is formed in the hinge structure configured to pivotally support the paper cover 3. Therefore, there is no need to separately form liquid discharge ports for discharging the liquid having entered the casing 2 in addition to the liquid discharge port formed at the hinge structure. Thus, a manufacturing load can be reduced. In particular, the opening in the hinge structure is a small opening. Such a small opening can contribute to the suppression of an increase in size of the liquid discharge port.

Further, the platen frame 35 in the platen unit 32, the left liquid discharge structure 60, and the right liquid discharge structure 70 are integrally formed. Therefore, the platen frame 35 and the liquid discharge structures 60 and 70 can be formed altogether, thereby being capable of contributing to the simplification of the manufacturing process. Moreover, the platen frame 35 and the liquid discharge structures 60 and 70 are integrally molded with a resin. Thus, compared to a case where, for example, the liquid discharge structures 60 and 70 are formed in the casing 2, the degree of freedom in designing a mold for molding the liquid discharge structure including the retaining baths 61 and 71 can be improved. As a result, it can contribute to the reduction in cost for molding.

An exemplary embodiment of the present invention is described above. However, the technical scope of the present invention is not limited to the above-mentioned embodiment, and various modifications can be made without departing from the gist of the present invention.

For example, in the above-mentioned embodiment, the retaining bath opening portion, which serves as the entrance for the liquid to flow into the retaining bath 61, is formed in the upper surface of the retaining bath 61. However, the retaining bath opening portion may be formed at other positions, for example, at an upper position of a side surface of the retaining bath 61. Further, in the above-mentioned embodiment, the retaining bath opening portion of the retaining bath 61 is in an opened state. However, there may be arranged a lid member for sealing the retaining bath opening portion. Through arrangement of the lid member, the liquid retained in the retaining bath 61 can be prevented from spilling out through the retaining bath opening portion.

Further, in the above-mentioned embodiment, the liquid discharge structures 60 and 70 are formed on the right and left sides of the flow path 80, respectively. However, the liquid discharge structure may be formed on one of the right and left sides. Further, the liquid discharge structures are arranged at the right and left positions of the flow path 80. However, the liquid discharge structures may be formed at other positions, for example, at the front and back positions of the flow path 80. Moreover, the liquid discharge structures may be formed at the front, back, right, and left positions, respectively.

Further, the small diameter port 62 is formed in the retaining bath bottom portion 61A. However, the small diameter port 62 may be formed at other positions, for example, at a lower position of the retaining bath side wall portion 61B in the gravitational direction. Further, the discharge port 64 is formed in the bottom portion 63C of the liquid guide region 63. However, the discharge port 64 may be formed at other positions, for example, at the lower position of the inner wall 63B or the lower position of the rear surface portion 63D in the gravitational direction.

Further, in the above-mentioned embodiment, the partition walls 65 and 75 are arranged further inward of the liquid guide regions 63 and 73. However, the partition walls 65 and 75 may be omitted. In this case, there may be formed a liquid entry prevention structure configured to prevent the entry of the liquid into the roll sheet receiving portion 21.

What is claimed is:

1. A thermal printer used in an operation position, comprising:

a housing having a roll sheet receiving portion configured to receive a recording paper therein;

a thermal head placed in the housing and configured to print on the recording paper drawn out from the roll sheet receiving portion, the thermal head having longitudinal ends and a longitudinal length, wherein the thermal head is positioned above the roll sheet receiving portion when the thermal printer is in the operation position;

a platen roller held in parallel contact with the thermal head and operable to feed the recording paper between the thermal head and the platen roller;

a delivery slot formed in the housing in parallel to the thermal head to discharge the recording paper fed from the thermal head outside of the housing, the delivery slot having a longitudinal length at least as long as the longitudinal length of the thermal head;

a liquid retaining portion positioned adjacent to at least one of the longitudinal ends of the thermal head, wherein the liquid retaining portion is positioned below the delivery slot when the thermal printer is in the operation positon; and a flow path having longitudinal ends and a longitudinal length at least as long as the longitudinal length of the delivery slot, the flow path being formed coextensive in parallel and adjacent to the delivery slot, wherein the longitudinal ends of the flow path are positioned above the liquid retaining portion in the operation position, and the flow path is configured to receive liquid flowed in the housing from the delivery slot and guide the liquid to flow along the longitudinal direction of the flow path down into the retaining portion in the operation position.

2. A thermal printer according to claim 1, wherein the flow path is formed to have a center, along its longitudinal length, which is positioned higher than the longitudinal ends thereof when the thermal printer is in the operation position, and the liquid retaining portion is provided adjacent to each longitudinal end of the thermal head.

3. A thermal printer according to claim 2, wherein the housing comprises:

a cover configured to open and close the roll sheet receiving portion; and a hinge portion for pivotally supporting the cover, and wherein the hinge portion has a liquid discharge port for discharging the liquid retained in the retaining portion to outside of the housing.

4. A thermal printer according to claim 3, further comprising a flow unit for guiding the liquid retained in the retaining portion to the liquid discharge port.

5. A thermal printer according to claim 4, further comprising a platen frame for supporting the platen roller, wherein the retaining portion is integrally formed with the platen frame.

6. A thermal printer according to claim 1, wherein the housing comprises:

a cover configured to open and close the roll sheet receiving portion; and a hinge portion for pivotally supporting the cover, and wherein the hinge portion has a liquid discharge port for discharging the liquid retained in the retaining portion to outside of the housing.

7. A thermal printer according to claim 6, further comprising a flow unit for guiding the liquid retained in the retaining portion to the liquid discharge port.

8. A thermal printer according to claim 1, further comprising a platen frame for supporting the platen roller, wherein the retaining portion is integrally formed with the platen frame.

* * * * *